US010605423B2

(12) United States Patent
Mornet et al.

(10) Patent No.: US 10,605,423 B2
(45) Date of Patent: Mar. 31, 2020

(54) DEVICE FOR POSITIONING A MODULE COMPRISING A LIGHT SOURCE ON AN OPTICAL DEVICE

(71) Applicant: VALEO VISION, Bobigny (FR)

(72) Inventors: Eric Mornet, Nogent sur Marne (FR); Bruno Ducloux, Sens (FR)

(73) Assignee: VALEO VISION, Bobigny (FR)

( * ) Notice: Subject to any disclaimer, the term of this patent is extended or adjusted under 35 U.S.C. 154(b) by 346 days.

(21) Appl. No.: 15/515,190

(22) PCT Filed: Sep. 25, 2015

(86) PCT No.: PCT/EP2015/072073

§ 371 (c)(1),
(2) Date: Mar. 29, 2017

(87) PCT Pub. No.: WO2016/050625

PCT Pub. Date: Apr. 7, 2016

(65) Prior Publication Data

US 2017/0211768 A1 Jul. 27, 2017

(30) Foreign Application Priority Data

Sep. 30, 2014 (FR) ..... 14 59306

(51) Int. Cl.
*F21S 41/19* (2018.01)
*F21S 43/31* (2018.01)
(Continued)

(52) U.S. Cl.
CPC ..... *F21S 41/19* (2018.01); *F21S 41/147* (2018.01); *F21S 41/32* (2018.01); *F21S 41/335* (2018.01);
(Continued)

(58) Field of Classification Search
None
See application file for complete search history.

(56) References Cited

U.S. PATENT DOCUMENTS 7,665,872 B2 * 2/2010 Nakabayashi ..... F21S 48/1104 362/519
2006/0044840 A1 * 3/2006 Watanabe ..... F21V 19/001 362/647
(Continued)

FOREIGN PATENT DOCUMENTS

EP 2 317 213 A2 5/2011
EP 2 484 967 A2 8/2012
(Continued)

OTHER PUBLICATIONS

International Search Report dated Jan. 12, 2016 in PCT/EP2015/072073 filed Sep. 25, 2015.
(Continued)

*Primary Examiner* — Britt D Hanley
(74) *Attorney, Agent, or Firm* — Oblon, McClelland, Maier & Neustadt, L.L.P.

(57) ABSTRACT

A lighting and/or signaling device, for a vehicle, including a light source positioned on a module assembled onto an optical device, the optical device and the module including a first reference mechanism including: at least one slideway mounted on the optical device, the slideway including an interior reference face placed opposite an interior guide face, and at least one extension extending from the module, the extension including a reference bearing face, opposite a contact face, the contact face including at least one contact point. The contact face is configured such that, when the extension has been introduced into the slideway along a direction of introduction, the contact face bears at the contact points against the interior guide face and, locally, at the contact point, the slideway and/or the extension are elastically deformed.

16 Claims, 3 Drawing Sheets

(51) Int. Cl.

| | |
|---|---|
| ***F21S 43/37*** | (2018.01) |
| ***F21S 41/147*** | (2018.01) |
| ***F21S 43/14*** | (2018.01) |
| ***F21S 43/19*** | (2018.01) |
| ***F21S 41/32*** | (2018.01) |
| ***F21S 41/33*** | (2018.01) |

(52) U.S. Cl.
CPC ..... *F21S 43/14* (2018.01); *F21S 43/19* (2018.01); *F21S 43/31* (2018.01); *F21S 43/37* (2018.01)

(56) References Cited

U.S. PATENT DOCUMENTS

| | | | | |
|---|---|---|---|---|
| 2006/0239021 | A1* | 10/2006 | Inaba | B60Q 1/0041 362/538 |
| 2007/0171667 | A1* | 7/2007 | Watanabe | F21V 19/0015 362/545 |
| 2012/0201039 | A1* | 8/2012 | Shibata | B60Q 1/0683 362/460 |
| 2014/0233245 | A1* | 8/2014 | Kerpe | H05K 1/0209 362/341 |
| 2017/0267161 | A1* | 9/2017 | Letoumelin | B60Q 1/06 |
| 2018/0058639 | A1* | 3/2018 | Blusseau | F21K 9/60 |
| 2018/0086249 | A1* | 3/2018 | Dorn | B60Q 1/0035 |

FOREIGN PATENT DOCUMENTS

| | | |
|---|---|---|
| EP | 2 484 967 A3 | 8/2012 |
| EP | 2 587 124 A1 | 5/2013 |
| GB | 2 107 037 A | 4/1983 |

OTHER PUBLICATIONS

French Search Report dated May 22, 2015 in FR 1459306 filed Sep. 30, 2014.

* cited by examiner

DEVICE FOR POSITIONING A MODULE COMPRISING A LIGHT SOURCE ON AN OPTICAL DEVICE

The invention relates to the field of lighting systems, and in particular to lighting systems intended, for example, to be fitted to motor vehicles.

A lighting system usually comprises a light source interacting with an optical device that may, for example, comprise an optical device acting as a reflector, a mirror and/or a set of lenses for distributing the light obtained from the light source in the lighting system.

In these conditions it is useful to position the light source in a precise manner with respect to the optical references of the optical system so that the light beam is directed appropriately toward the outside of the lighting system.

This requirement for geometric precision has increased with the use of light sources formed by light-emitting diodes, and more particularly with the use of high-power laser diodes which enable the light emission to be concentrated at a precise point of very small size. These diodes are mounted on a module which acts as a heat sink and also serves as a support for the electrical connection members used to supply the diode.

Consequently there is need to provide a connecting means for coupling this module to the optical device in such a way that the light source is positioned at a predefined point in the geometric reference frame of the optical device, and that the light rays emitted by the light source are oriented at precise angles in this reference frame.

By way of example, the publication DE 10 2010 048 594 describes a coupling device of a light source installed on a module mounted on a heat sink which is coupled to an optical device acting as the optical device. The heat sink comprises a housing having reference faces against which the module is made to bear by resilient means such as springs. This device may be used to achieve the objectives described above, but requires the use of a large number of parts, and a number of springs equal to the number of reference axes, thus complicating the production and assembly of the device.

The invention therefore concerns a lighting device, notably a lighting and/or signaling device, for a vehicle, comprising a light source positioned on a module assembled onto an optical device.

This device is characterized in that the optical device and the module have first reference means, comprising:

- at least one slideway mounted on the optical device, said slideway having an interior reference face placed opposite an interior guide face, and
- at least one extension extending from the module, said extension having a reference bearing face, opposite a contact face, said contact face having at least one contact point, the contact face being arranged so that, when the extension has been introduced into the slideway in a direction of introduction, the contact face bears at the contact points against the interior guide face, and the slideway and/or the extension are elastically deformed locally at the contact points. The high-power diode is mounted on the module, which may act as a heat dissipater, and the assembly is then directly assembled onto the optical device by making the extensions penetrate into the slideways. The geometric position of the module with respect to the optical device is then secured by making the reference bearing face of the module bear against the interior reference face of the slideway forming part of the optical device.

The protuberance, owing to its very small bearing face, facilitates its own deformation and that of the guide face of the slideway on which it bears, the whole operation being performed with limited force, thereby limiting the risk of breakage. The deformation of the system consisting of the protuberance and the guide face of the slideway compensates for the mechanical tolerances of the various elements, thus permitting precise adjustment, regardless of the manufacturing tolerances, of the interior reference face of the slideway against the reference face of the extension.

The protuberances, which act to some degree as mechanical catches, thus enable these reference faces to be made to bear without creating false contacts as a result of irregularities in the smoothness of the sliding face or irregularities in the shape of the extension.

The lighting system according to the invention may also have the following characteristics, separately or in combination:

- The contact point or points are positioned on one or more protuberances projecting from the contact face.
- The interior reference face and the interior guide face of the slideway form between them a given angle about an axis which is parallel to the interior reference face and the interior guide face of the slideway, and is substantially perpendicular to the direction of introduction of the extension into the slideway.
- The angle formed by the interior reference face and the interior guide face of the slideway is in the range from 1° to 10°, or preferably from 2° to 6°.
- The contact face comprises at least a first and a second contact point, the first contact point being positioned before the second contact point on the contact face along the direction of introduction.
- The extension has a different thickness at each contact point, this thickness being measured normally to the reference bearing face, between said contact point and the reference bearing face, the thickness of the extension at the first contact point being smaller than the thickness of the extension at the second contact point.
- The contact points lie within a plane of alignment forming an angle with the reference bearing face about an axis which is parallel to the reference bearing face and the plane of alignment, and is substantially perpendicular to the direction of introduction of the extension into the slideway.
- The plane of alignment and the reference bearing face form an angle between them substantially equal to the angle formed by the interior reference face and the interior guide face of the slideway.
- At least one protuberance has a substantially hemispherical shape, such that said protuberance rests on the interior guide face of the slideway with a quasi-point contact.
- At least one protuberance has a cylindrical shape, such that said protuberance rests on the interior guide face of the slideway with a quasi-linear contact.
- The module comprises two extensions, extending laterally on either side of said module, which are introduced into two slideways positioned on the optical device facing each other.
- The lighting device comprises second reference means carried by the modulus and the optical device, for locking the movements of the module with respect to the optical device along the direction of introduction, and comprising a second reference face against which a second reference element bears when the extension of the module is introduced into the slideway.

The second reference face is substantially perpendicular to the direction of introduction (OX).

The second reference face is formed by an interior face of the slideway, and the second reference element is formed by a front edge of the extension.

The second reference face is formed by a face located on a projection of the optical device, and the second reference element is formed by a face of a positioning wall of the module which is substantially perpendicular to the direction of introduction.

The lighting device comprises second reference means carried by the modulus and the optical device, for blocking the movement of the module with respect to the optical device along a direction parallel to the interior reference face and to the interior guide face of the slideway, and substantially perpendicular to the direction of introduction of the extension into the slideway.

The third reference means are formed by guide means of the optical device and by a guide opening of the module.

The optical device is made of an injection-molded thermosetting or thermoplastic material.

The module is made by cutting and bending a metal sheet, and the protuberances are formed by pressing.

The light source is a semiconductor emitting chip, preferably a light-emitting diode, and more particularly a laser diode.

The module supporting the light source acts as a heat dissipater intended to discharge the heat energy produced by the light source.

The present invention also relates to a lighting device, notably a lighting and/or signaling device, for a vehicle, comprising a light source positioned on a module (3) assembled onto an optical device. The module comprises a guide opening for assembling the module onto the device and a fixing opening for fixing the module to the device, the fixing opening and the guide opening being placed in a first pair of respective positions on the module when the optical device is intended to provide a first photometric function, and the fixing opening and the guide opening being placed in a second pair of respective positions on the module when the optical device is intended to provide a second photometric function.

The lighting system according to the invention may also have the following characteristics, separately or in combination:

The optical device is arranged to provide a single photometric function chosen from the first and second photometric functions.

The first photometric function is a lighting function of the low beam type, and the second photometric function is a lighting function of the high beam type.

The fixing opening is positioned in a first position on the module and the guide opening is positioned in a second position on the module when the optical device is intended to provide the first photometric function, and the fixing opening is positioned in said second position on the module and the guide opening is positioned in said first position on the module when the optical device is intended to provide the second photometric function.

The optical device comprises a guide means intended to interact with the guide opening for the assembly of the module onto the device, and a fixing opening intended to interact with the fixing opening of the module and a fixing means for fixing the module to the device.

The fixing opening of the device and the guide means are placed in a first pair of respective positions on the optical device when the optical device is intended to provide a first photometric function, and the fixing opening of the device and the guide are placed in a second pair of respective positions on the optical device when the optical device is intended to provide a second photometric function.

The guide opening is an oblong hole, and the guide means is a guide lug.

The guide lug has a circular cross section.

The fixing opening of the module is a cruciform or round hole, and the fixing opening of the device is a circular hole.

The invention will be more easily understood from a perusal of the attached drawings, which are provided by way of example to support the following description and are not in any way limiting, in which drawings.

Figure 1:
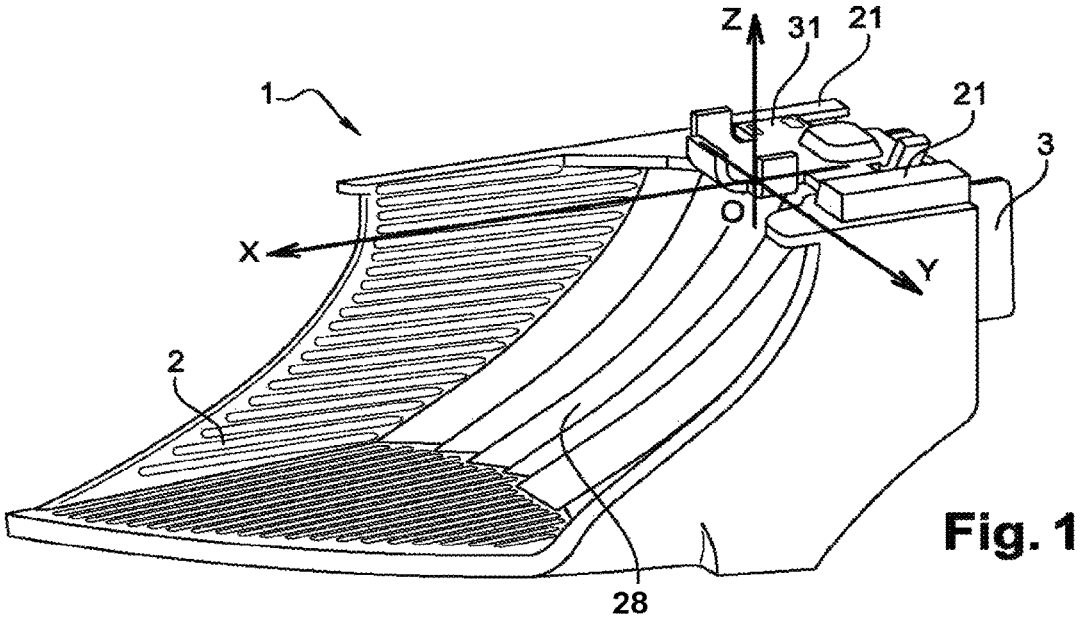
FIG. 1 shows a perspective view of a lighting system according to the invention, after assembly.

FIG. 1 shows a lighting system 1 comprising an optical device 2 on which is directly mounted a module 3 supporting a light-emitting diode. The module 3 is mounted on the optical device 2 by means of two slideways 21, which form an integral part of the optical device 2, and into which extensions 31 forming part of the module 3 are inserted.

The module 3 supporting the diode may also act as a heat sink and heat dissipater for discharging the heat produced by the diode. The module is preferably manufactured from a metal sheet which is cut out, pressed and bent to a desired shape.

The optical device 2 is usually made by injection of a thermosetting material or a plastic material, preferably thermoplastic, on which treatments are carried out to provide surfaces acting as mirrors 28. The slideways 21 are made in one piece with the optical device 2, and are therefore positioned in a precise manner in the reference frame of the optical device 2. An orthonormal reference frame OXYZ, corresponding to the reference frame of the optical device 2, may be used for the precise definition of the position in space of the characteristic points of this optical device, such as the position of the surface of the generally parabolically shaped mirror 28, or of the focal points, etc.

The light source placed on the module must therefore be positioned precisely in this reference frame in order to optimize the operation of the lighting system. The ideal position of the light source has been positioned in the geometric center O of the reference frame.

Figure 2:
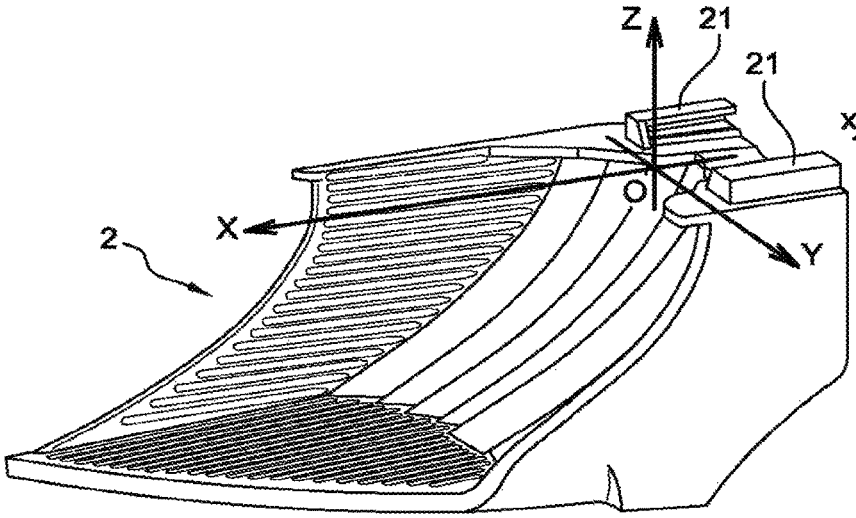
FIG. 2 shows an optical device.

FIG. 2 shows the optical device 2 before mounting, in which the slideways 21 designed to receive the extensions 31 are disengaged.

Figure 3:
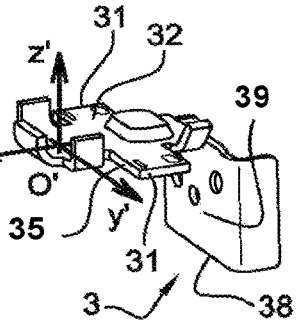
FIG. 3 shows a perspective view of a module according to the invention in a first orientation of the axial reference frame.
Figure 4:
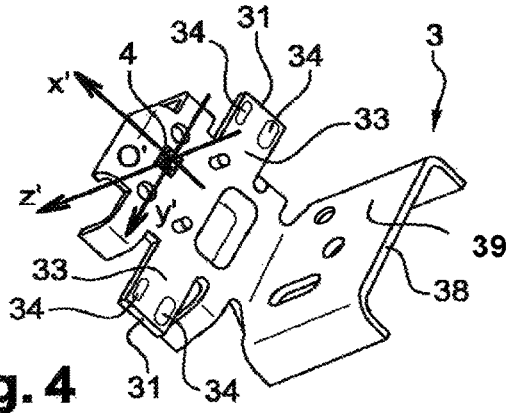
FIG. 4 shows the same module according to a second orientation of the axial reference frame.

FIGS. 3 and 4 show perspective views of the module 3 before mounting on the optical device 2, in two different positions of the axial reference frame o'x'y'z' which is centered on the high-power diode 4. The module 3 comprises two extensions 31, positioned on either side of the module.

Each extension 31 comprises a reference bearing face 32 and a contact face 33, opposite the reference bearing face and supporting contact points P, represented here by protuberances 34 which project from the contact face 33 of the extension.

After mounting, the axes of the reference frames OXYZ and o'x'y'z' must therefore coincide very precisely, so that the center of the diode 4 is placed very exactly at the geometric point O forming the center of the optical device 2. The axis OX here represents the general direction of introduction of the extensions 31 into the slideways 21.

Figure 5:
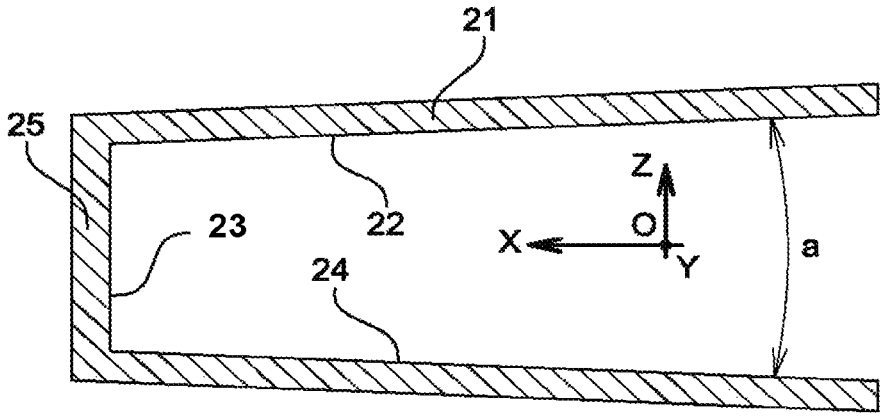
FIG. 5 shows a sectional view of a slideway according to the invention.
Figure 6:
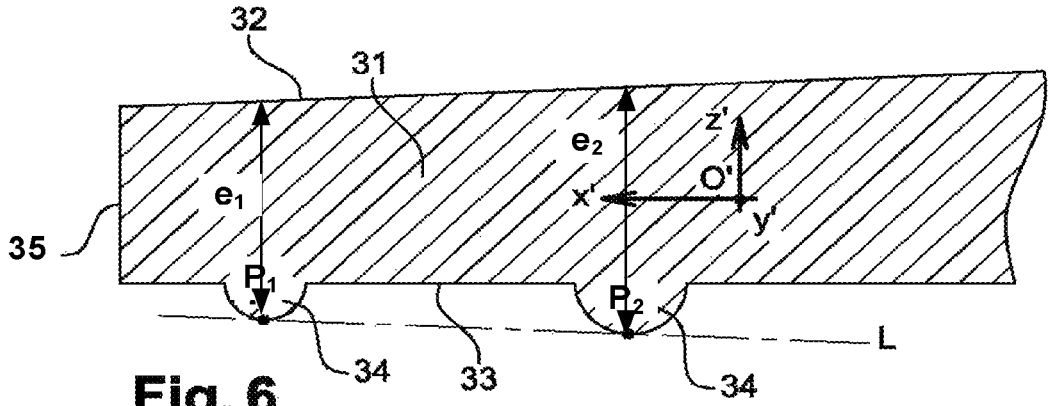
FIG. 6 shows a sectional view of an extension according to the invention.
Figure 7:
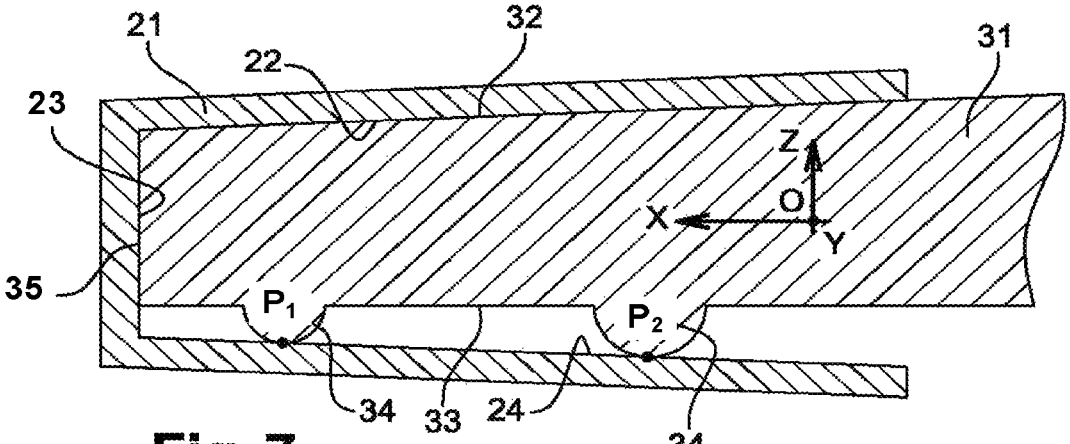
FIG. 7 shows a sectional view of the slideway into which the extension has been inserted.

The following FIGS. 5, 6 and 7 provide a detailed view of the shape of the extension 31 and of the slideway 21, which form the first reference means.

FIG. 5 shows a slideway 21 according to the invention. The slideway 21 comprises an interior reference face 22 and an interior guide face 24, positioned opposite said interior reference face. These two faces preferably form a given angle "a" between them about the axis OY, which is an axis parallel to the two faces 32 and 33 and perpendicular to the axis OX representing the general direction of introduction of the module into the slideways 21 of the optical device 2. This angle "a" may usefully be in the range from 1° to 10°, or preferably from 2° to 6°. Good experimental results have been obtained with an angle of 3°. This angular value, conventionally called the taper angle, allows easier demolding of the optical device 2, among other benefits.

The cross section of the extension 31 shown in FIG. 6 illustrates the case of an extension 31 whose contact face 33 comprises at least first and second contact points, the first contact point $P_1$ being positioned before the second contact point $P_2$ on the contact face along the direction of introduction (o'x'). These first and second contact points are formed, in the case of FIG. 6, by two protuberances 34 offset from each other in the direction of the axis o'x'.

FIG. 7 shows the extension 31 after it has been introduced into the slideway 21. The reference bearing face 32 of the extension 31 is in full contact with the interior reference face 22 of the slideway. The protuberances 34 bear on the interior guide face 24 by means of the contact points P.

The protuberance may have a hemispherical shape, in which case the bearing between the protuberance and the interior guide face 24 takes the form of a virtual point contact. It is also possible to form protuberances of substantially cylindrical shape, the generatrices of which lie along the direction o'y' perpendicular to the direction of introduction o'x', in which case the contacts between the protuberance and the interior guide face 24 of the slideway are established along a peak line forming a virtually linear contact. These shapes have the advantage of being easily produced by the pressing of the extensions 31 if the module is made from a metal sheet, but are not limiting.

To achieve the aforementioned wedge effect, provision is made for the extension 31 to have a different thickness e at each contact point P, this thickness being measured normally to the reference bearing face 32, between said contact point P and the reference bearing face 32. The thickness $e_1$ of the extension 31 at the first contact point $P_1$ is less than the thickness $e_2$ of the extension at the second contact point $P_2$.

Provision is also made for the contact points P to be included in a plane of alignment L, shown in broken lines in FIG. 6, and for the plane of alignment L to form a given angle with the plane of the reference bearing face 32 of the extension. This angle is substantially equal to the angle "a" formed between the interior reference face 22 and the interior guide face 24 of the slideway 21.

The purpose of the protuberances 34 is to force the reference bearing face 32 of the extension 31 to bear on the interior reference face 22 of the slideway, without being affected by any irregularities in form of the interior sliding face 24 and the contact face 33 of the extension. The number of protuberances is therefore not limiting.

In fact, once the two reference faces 22 and 32 are in contact, any movements of the module along the axis OZ and about the axis OX and the axis OY are theoretically blocked.

An extension with only one protuberance may therefore serve this purpose. The presence of two protuberances of substantially cylindrical shape, as shown in FIG. 4, makes it possible to strengthen the angular positioning of the module about these two axes OX and OY. An equivalent result may be achieved by using, for example, three protuberances of hemispheric shape, arranged in a triangle.

The aforementioned wedge effect is strengthened if the protuberance 34 slightly presses into the interior guide face 24 of the slideway. The material, preferably metal, of which the module 3 is formed is much harder than the thermoplastic material forming the optical device 2 and the slideway 21. Since the contact surface between the protuberance 34 and the interior guide face 24 is reduced, the protuberance elastically deforms the guide face locally around the contact point, thereby increasing the pressure force between the two reference faces 22 and 32.

In this case, "elastic deformation" is taken to mean that the deformation is reversible, and that the interior guide face 24 of the slideway recovers its original shape entirely when the module 3 is withdrawn from the lighting device.

It will also be noted that it is possible to make the slideway of a harder material than the module 3. In this case, it is the protuberance that undergoes the elastic deformation in order to achieve the same effects as those described above.

Thus it would be correct to speak of the elastic deformation of the system formed by the pair consisting of the protuberance and the interior guide face.

The designer of the lighting device is therefore free to choose the shape and material of the slideway 21 or of the protuberances 34 of the module in such a way that they undergo the desired elastic deformation, and to choose which of these two elements will be deformed less.

Finally, in order to achieve this effect in an optimal way, care will be taken to ensure that the number of contact points is reduced, or, in other words, that the contact surface of the protuberances with the interior guide face 24 is smaller, and preferably much smaller, than the contact surface between the interior reference face 22 of the slideway 21 and the reference bearing face 32 of the extension 3.

The number and shape of the slideways 21 is not limiting. Moreover, a single slideway could provide all the functions described above for the geometrical positioning of the module. However, the presence of two slideways, positioned symmetrically either side of the plane OXZ, makes it possible to reduce the rotation that may occur about the axis OX.

The shape of the slideways 21 may also be the subject of variants. The slideways shown in the figures have a lateral opening in the plane formed by the axes OXZ. In an equivalent manner, it would be equally feasible to form a slideway having an opening in a frontal plane perpendicular to the axis of introduction OX. The orientation of the extension 31 is then modified accordingly. Similarly, the interior reference face 22 of the slideway may be located in an equivalent manner in an upper or lower position upper along the direction OZ.

The invention also provides second reference means, for blocking the movements of the module 3 with respect to the optical device 2 along the general direction of introduction OX.

These second reference means are formed by a second reference face (23, 29) carried by the optical device 2, which is perpendicular to the axis OX, and a second reference element (35, 39) carried by the module 3 and bearing against said second reference face.

The second reference face may be supported, for example, by a wall 25 of the slideway 21 connecting the interior reference face 22 and the interior guide face 24, the interior face 23 of which wall, acting as a second reference face, is intended to bear against second reference elements 35 positioned on the front part of the extensions 31, as shown in FIGS. 3, 5, 6 and 7.

Figure 8:
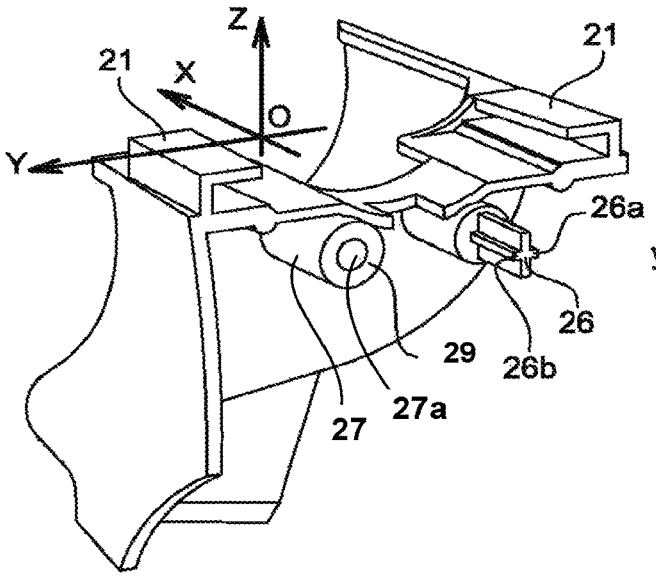
FIG. 8 shows a perspective view of the rear of an optical device according to the invention.

FIG. 8 shows another embodiment, in which the second reference face 29 (see also FIGS. 3 and 4) is carried by a projection 27 located on the back part of the optical device 2. The second reference face 29 is substantially perpendicular to the axis OX. The second reference element 39 is carried by the front face of a positioning wall 38 of the module 3, which is also perpendicular to the axis of introduction OX. When the module has been mounted in the slideway 21, the second reference element 39 bears against the second reference face 29 of the optical device 2.

The projection 27 may usefully comprise a fixing opening 27*a* intended to interact with a fixing opening 37 formed in the positioning wall 38 of the module 3. The fixing opening 37 of the module 3 may have the general shape of a round hole. A fixing means 5, for example, but not limited to, a screw, a stop washer, or a system made of spring plate, passing through the fixing opening 37, and entering the fixing opening 27*a*, may then be used to fix the module 3 to the optical device 2, and to block the movement of the module 3 with respect to the optical device 2 along the axis of introduction OX.

To facilitate the introduction of the module 3 into the optical device 2, it is possible to provide a guide means 26, fitted on the optical device 2 and intended to interact with a guide opening 36 in the module. The guide opening 36 has a substantially oblong shape in the direction of the axis OZ, so as not to impede the adjustment in this direction of the interior reference face 22 of the slideway with the reference bearing face 32 of the extension 31.

The guide means 26 may have the shape of a peg of circular section (not shown) whose longitudinal direction lies along the axis OX, and which is sufficiently long in the direction of the axis OX to penetrate into the guide opening 36 during the assembly operation.

The guide means (26, 36) and fixing means (27*a*, 37, 5) may also act as location elements, for example if the module 3 is to be assembled onto optical devices 2 having distinct photometric lighting functions of the right/left and/or high/low beam type.

The fixing opening 37 and the guide opening 36 are then placed in a first pair of respective positions on the module 3 when the optical device 2 is intended to provide a first photometric function, such as a high beam lighting function, and the fixing opening 37 and the guide opening 36 are placed in a second pair of respective positions on the module 3 when the optical device 2 is intended to provide a second photometric function, such as a low beam lighting function.

For its part, the optical device 2 is arranged to provide a single photometric function chosen from the first and second photometric functions.

It is then possible to use substantially identical modules 3, differing only in the respective positions of the guide openings 36 and the fixing openings 37, on optical devices 2 having different photometric functions, on which devices the positions of the guide means 26 and the fixing opening 27*a* are adapted accordingly.

It is also possible, by way of example, to reverse the respective positions of the fixing opening 37 and the centering opening 36.

Thus, in the first pair of positions, the fixing opening 37 is positioned in a first position on the module 3 and the guide opening 36 is positioned in a second position on the module 3 when the optical device 2 is intended to provide the first photometric function. Additionally, the fixing opening 37 is positioned in said second position on the module 3 and the guide opening 36 is positioned in said first position on the module 3 when the optical device 2 is intended to provide the second photometric function.

In a complementary manner, and with the aim of pairing up a module with the appropriate optical device 2 and placing the guide means 26 and the guide opening 36 in corresponding positions, as well as the fixing opening 27*a* of the optical device 2 and the fixing opening 37 of the module, the fixing opening 27*a* and the guide means 26 of the optical device 2 are placed in the first pair of respective positions when the optical device 2 is intended to provide the first photometric function, and the fixing opening 27*a* and the guide means 26 of the optical device 2 are placed in the second pair of respective positions when the optical device 2 is intended to provide the second photometric function.

The embodiment of the location element as detailed above is not limiting, and may be the subject of numerous variants in which guide means and fixing means are placed in clearly defined locations to permit the assembly of standard elements, in this case modules for supporting a diode, which are slightly modified according to their intended use, onto members providing different functions, in this case optical devices providing distinct photometric functions.

Finally, the lighting system according to the invention may comprise third reference means for blocking the movement of the module with respect to the optical device along the axis OY.

Figure 9:
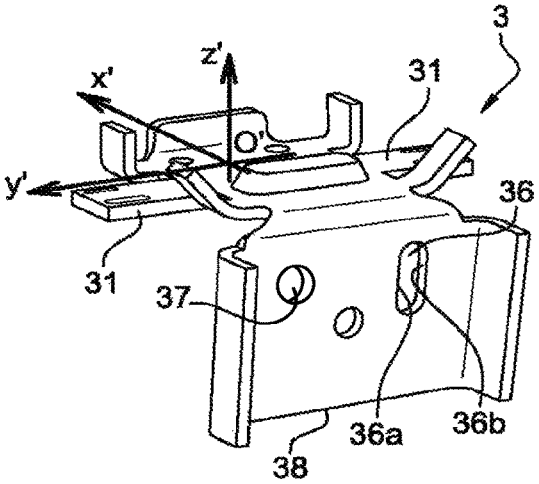
FIG. 9 shows a perspective view of the rear part of the module.
Figure 10:
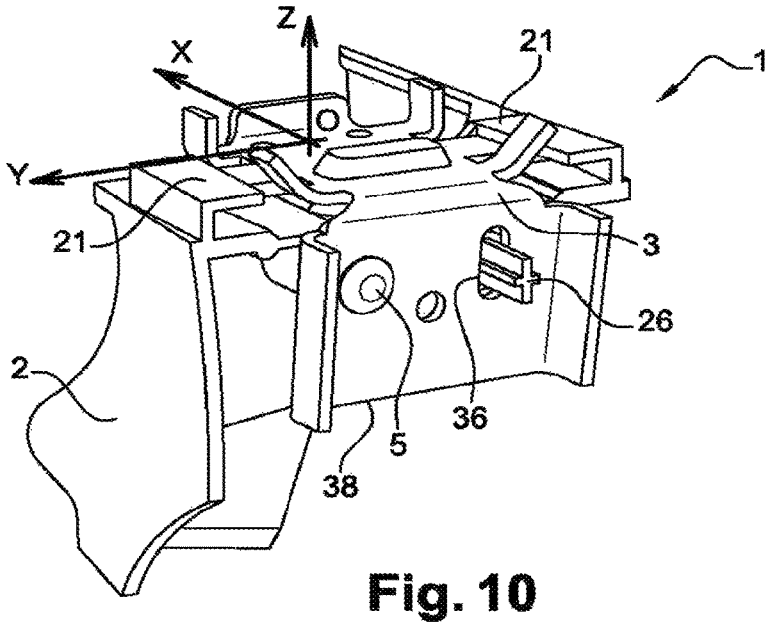
FIG. 10 shows a perspective view of the rear of a lighting system according to the invention, after assembly.

These third reference means may usefully be positioned on the guide means 26 carried by the optical device 2. The guide means comprise, as shown in FIGS. 8 and 9, lateral fins 26*a* and 26*b* bearing against the lateral edges 36*a* and 36*b* of the guide opening 36, in the direction o'y'.

In a variant embodiment, for a more precise positioning of the light source, the third reference means may be formed by a third slideway. In this case, the optical device comprises three slideways 21, each oriented along the axis OX, of which two are coplanar and the third slideway is located in a plane substantially perpendicular to the first two slideways. The module then comprises a third extension 31 intended to interact with the third slideway 21. In this last-mentioned configuration, it is necessary to slightly enlarge the fixing opening 37 and the guide opening 36 in the direction OY, so as to leave a clearance for the adjustment of the position of the module 3 in the direction OY.

The assembly of the module 3 onto the optical device 2 is carried out in an extremely simple way, by introducing the guide means 26, in the direction OX, into the guide opening 36, so as to cause the extensions 31 to enter the slideways 21. This introduction movement is interrupted when the second reference element 35 or 39 respectively comes to bear against the second reference face 23 or 29 respectively. The screw 5 may be used to lock the assembly in the two directions of the axis OX.

The module 3 supporting the light source 4 may be mounted and removed easily, thus facilitating any work that may need to be done on the lighting system in the course of the maintenance of the vehicle.

The light source 4 is then perfectly positioned in the center O of the optical device 2, and any movement of the module 3 along or about the axes OX, OY and OZ is prevented.

The embodiments of the invention described above are not limiting, and those skilled in the art will be able to derive teachings from the above instructions to achieve the desired objects using equivalent forms and arrangements.

LEGEND

1 Lighting device
2 Optical device
21 Slideway
22 Interior reference face of the slideway 21
23 Second reference face of the slideway 21
24 Interior guide face of the slideway 21
25 Wall of the slideway carrying the second reference face 29
26 Guide means carried by the optical device 2
26*a*, 26*b* Lateral fins of the guide means 26
27 Projection
27*a* Fixing opening of the optical device 2
28 Mirror surface
29 Second reference face carried by the optical device 2
3 Module
31 Extension
32 Reference bearing face
33 Contact face
34 Protuberance
35 Second reference face carried by the extension 3
36 Guide opening
36*a*, 36*b* Lateral edges of the guide opening 36
37 Fixing opening of the module
38 Positioning wall
39 Second reference element carried by the positioning wall 38
4 Light source
5 Fixing means

The invention claimed is:

1. A lighting device and/or signaling device, for a vehicle, comprising:

a light source positioned on a module assembled onto an optical device;

wherein the optical device includes at least one slideway mounted on the optical device, the slideway including an interior reference face placed opposite an interior guide face; and the module includes at least one extension extending from the module, the extension including a reference bearing face, opposite a contact face, the contact face including at least two contact points protruding from the contact face, the at least two contact points being separated by an offset;

the contact face configured such that, when the extension has been introduced into the slideway in a direction of introduction, the contact face bears at the at least two contact points against the interior guide face, and the slideway and/or the extension are elastically deformed locally at each contact point.

2. The lighting device as claimed in claim 1, wherein the at least two contact points are positioned on one or more protuberances projecting from the contact face.

3. The lighting device as claimed in claim 1, wherein the interior reference face and the interior guide face of the slideway form a given angle between them about an axis which is parallel to the interior reference face and the interior guide face of the slideway, and is substantially perpendicular to the direction of introduction of the extension in to the slideway.

4. The lighting device as claimed in claim 1, a first contact point is positioned before a second contact point on the contact face along the direction of introduction.

5. The lighting device as claimed in claim 4, wherein the extension has a different thickness at each contact point, the thickness being measured normally to the reference bearing face, between each contact point and the reference bearing face, thickness of the extension at the first contact point being smaller than thickness of the extension at the second contact point.

6. The lighting device as claimed in claim 4, wherein the contact points lie within a plane of alignment forming an angle with the reference bearing face about an axis which is parallel to the reference bearing face and to the plane of alignment and substantially perpendicular to the direction of introduction of the extension into the slideway.

7. The lighting device as claimed in claim 6, wherein the plane of alignment and the reference bearing face form an angle between them substantially equal to the angle formed by the interior reference face and the interior guide face of the slideway.

8. The lighting device as claimed in claim 2, wherein at least one protuberance has a substantially hemispherical shape, such that the at least one protuberance rests on the interior guide face of the slideway with a quasi-point contact.

9. The lighting device as claimed in claim 2, wherein at least one protuberance has a cylindrical shape, such that the at least one protuberance rests on the interior guide face of the slideway with a quasi-point contact.

10. The lighting device as claimed in claim 1, wherein the module comprises two extensions, extending laterally on either side of the module, which are introduced into two slideways positioned on the optical device facing each other.

11. The lighting device as claimed in claim 1, further comprising second reference means carried by the module and the optical device, for blocking movements of the module with respect to the optical device along the direction of introduction, and comprising a second reference face against which a second reference element bears when the extension of the module is introduced into the slideway.

12. The lighting device as claimed in claim 11, wherein the second reference face is formed by an interior face of the slideway, and wherein the second reference element is formed by a front edge of the extension.

13. The lighting device as claimed in claim 11, wherein the second reference face is formed by a face located on a projection of the optical device, and wherein the second reference element is formed by a face of a positioning wall of the module which is substantially perpendicular to the direction of introduction.

14. The lighting device as claimed in claim 11, further comprising third reference means carried by the module and the optical device, for blocking movement of the module with respect to the optical device along a direction parallel to the interior reference face and the interior wide face of the slideway, and substantially perpendicular to the direction of introduction of the extension into the slideway.

15. The lighting device as claimed in claim 14, wherein the third reference means is formed by guide means of the optical device and by a guide opening of the module.

16. A device for a lighting system for a vehicle, comprising:

an optical device including at least one slideway mounted on the optical device, the slideway including an interior reference face placed opposite an interior guide face; and a module including at least one extension extending from the module, the extension including a reference bearing face, opposite a contact face, the contact face including at least two contact points protruding from the contact face, the at least two contact points being separated by an offset, wherein the contact face is configured such that, when the extension has been introduced into the slideway in a direction of introduction, the contact face bears at each contact point against the interior guide face, and the slideway and/or the extension are elastically deformed locally at each contact point.

* * * * *